US008647149B2

(12) United States Patent
Tanaka et al.

(10) Patent No.: US 8,647,149 B2
(45) Date of Patent: Feb. 11, 2014

(54) CONNECTING MEMBER-TERMINATED MULTI-CORE COAXIAL CABLE AND METHOD FOR MANUFACTURE THEREOF

(75) Inventors: Masato Tanaka, Kanuma (JP); Kazuhiro Sato, Kanuma (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 29 days.

(21) Appl. No.: 13/266,418

(22) PCT Filed: Oct. 18, 2010

(86) PCT No.: PCT/JP2010/068239
§ 371 (c)(1),
(2), (4) Date: Oct. 26, 2011

(87) PCT Pub. No.: WO2011/049028
PCT Pub. Date: Apr. 28, 2011

(65) Prior Publication Data

US 2012/0040556 A1 Feb. 16, 2012

(30) Foreign Application Priority Data

Oct. 22, 2009 (JP) ..... 2009-243206

(51) Int. Cl.
*H01R 9/05* (2006.01)

(52) U.S. Cl.
USPC ..... 439/579; 174/28

(58) Field of Classification Search
USPC ..... 439/579, 578, 479, 493
See application file for complete search history.

(56) References Cited

U.S. PATENT DOCUMENTS 3,078,436 A * 2/1963 Berry ..... 439/579
3,248,473 A * 4/1966 Buhmann ..... 174/29
3,291,897 A * 12/1966 Bramley ..... 174/126.1
4,451,108 A * 5/1984 Skidmore ..... 439/536
4,558,918 A * 12/1985 Shores ..... 439/579

(Continued)

FOREIGN PATENT DOCUMENTS

DE 2522623 A1 12/1975
EP 1887659 A1 2/2008

(Continued)

OTHER PUBLICATIONS

Chinese Office Action of the corresponding Chinese Patent Application No. 201080019241.0, dated Dec. 5, 2012.

(Continued)

*Primary Examiner* — Amy Cohen Johnson
*Assistant Examiner* — Vladimir Imas
(74) *Attorney, Agent, or Firm* — Global IP Counselors, LLP

(57) ABSTRACT

A multi-core coaxial cable is composed of includes a plurality of coaxial cables, each of which having an insulator, an outer conductor, and a sheath successively disposed in a coaxial arrangement around a center conductor, and which are collectively covered by a cable sheath. At one end portion of the multi-core coaxial cable, the plurality of coaxial cables are exposed from the cable sheath and arranged in parallel rows. A connecting member is connected to one end of the multi-core coaxial cable, and the center conductors and outer conductors of the plurality of coaxial cables are respectively conductively connected to terminal portions of the connecting member. The covering member is positioned covering the periphery of the plurality of coaxial cables between the cable sheath and the connecting member.

13 Claims, 7 Drawing Sheets

(56) References Cited

U.S. PATENT DOCUMENTS

| | | | | |
|---|---|---|---|---|
| 4,602,832 | A * | 7/1986 | Cunningham et al. | 439/108 |
| 4,614,398 | A * | 9/1986 | Wright et al. | 439/579 |
| 5,002,502 | A * | 3/1991 | Hill | 439/536 |
| 5,470,253 | A * | 11/1995 | Siems et al. | 439/491 |
| 5,478,258 | A * | 12/1995 | Wang | 439/581 |
| 5,561,185 | A * | 10/1996 | Hashimoto et al. | 524/436 |
| 5,906,511 | A * | 5/1999 | Bozzer et al. | 439/579 |
| 6,013,875 | A * | 1/2000 | Fridenberg et al. | 174/68.3 |
| 6,036,539 | A * | 3/2000 | Rigby et al. | 439/579 |
| 6,053,770 | A * | 4/2000 | Blom | 439/579 |
| 6,129,581 | A * | 10/2000 | Lee | 439/497 |
| 6,287,145 | B1 * | 9/2001 | Goett | 439/579 |
| 6,380,485 | B1 * | 4/2002 | Beaman et al. | 174/88 R |
| 6,716,057 | B1 * | 4/2004 | Wu | 439/497 |
| 6,752,633 | B2 * | 6/2004 | Aizawa et al. | 439/63 |
| 6,812,401 | B2 * | 11/2004 | Karrmann | 174/28 |
| 6,849,799 | B2 * | 2/2005 | Springer et al. | 174/28 |
| 6,945,817 | B2 * | 9/2005 | Miyazaki et al. | 439/579 |
| 6,991,493 | B2 * | 1/2006 | Matsui et al. | 439/579 |
| 7,273,393 | B2 * | 9/2007 | van Meijl | 439/579 |
| 7,361,831 | B2 * | 4/2008 | Tanaka et al. | 174/28 |
| 7,413,474 | B2 * | 8/2008 | Liu et al. | 439/579 |
| 8,303,337 | B2 * | 11/2012 | Ballard et al. | 439/578 |
| 2006/0144613 | A1 * | 7/2006 | Buck et al. | 174/113 R |
| 2008/0035367 | A1 * | 2/2008 | Tanaka et al. | 174/102 R |

FOREIGN PATENT DOCUMENTS

| | | | |
|---|---|---|---|
| GB | 1508997 | | 4/1978 |
| JP | 1991-100322 | U | 10/1991 |
| JP | 2002-135938 | A | 5/2002 |
| JP | 2002-184485 | A | 6/2002 |
| JP | 2003-123552 | A | 4/2003 |
| JP | 2006-196418 | A | 7/2006 |
| JP | 2006-236982 | A | 7/2006 |
| JP | 2008135938 | A | 6/2008 |
| JP | 2008-258053 | A | 10/2008 |
| WO | WO-99/19213 | A2 | 4/1999 |

OTHER PUBLICATIONS

First Office Action of the corresponding Austrian Patent Application No. 3A A 9196/2010, dated Feb. 21, 2012.

Japanese Office Action of the corresponding Japanese Patent Application No. 2009-243206, dated Oct. 8, 2013.

* cited by examiner

CONNECTING MEMBER-TERMINATED MULTI-CORE COAXIAL CABLE AND METHOD FOR MANUFACTURE THEREOF

BACKGROUND OF THE INVENTION

1. Technical Field

The present invention relates to a multi-core coaxial cable with an attached connecting member, and to a method for manufacturing thereof.

2. Background Art

Japanese Patent Application No. 2003-123552 (Patent Citation 1) discloses a multi-core coaxial cable composed of a number of ultrafine coaxial cables, each of which has an inner conductor with outside diameter of approximately 0.15 mm or smaller covered by an insulator, an outer conductor disposed on the outside periphery of the insulator, and a jacket sheathing the outside of the outer conductor, and which are twisted together. In the ultrafine coaxial cables, there are provided parallel bonded portions and unbonded portions of given span.

Where a multi-core coaxial cable is to be connected to a connecting member such as a circuit board, terminal processing, which involves exposing the center conductor and the outer conductor of each coaxial cable from the cable sheath of the multi-core coaxial cable and connecting them to the circuit board by soldering, is carried out by a manual procedure. Where the multi-core coaxial cable is to be used in a medical device such as an endoscope, in certain instances it may be necessary to shorten the distance from the end portion of the cable sheath to the circuit board to a dimension of about 2 to 3 mm, for example, to limit exposure of the coaxial cable as much as possible. In such instances, terminal processing of the coaxial cables by a manual procedure is difficult, and dimensional accuracy tends to be poor and the defect rate is high. It may be contemplated to carry out terminal processing by squeezing and moving the cable sheath to expose a greater processing length of the coaxial cables, and to subsequently return the sheath to its original place; however, for multi-core coaxial cables whose sheaths have high cohesive force, the sheath may not readily move, making terminal processing difficult.

DISCLOSURE OF THE INVENTION

Technical Problems

It is accordingly an object of the present invention to provide a multi-core coaxial cable with an attached connecting member that affords ease of terminal processing, good dimensional accuracy, and a negligible defect rate, as well as a method for manufacturing thereof.

Means Used to Solve the Above-Mentioned Problems

To attain this object, there is provided a connecting member-terminated multi-core coaxial cable that includes a multi-core coaxial cable, a connecting member, and a covering member. In this multi-core coaxial cable, the multi-core coaxial cable is composed of a plurality of coaxial cables collectively covered by a cable sheath, each of the cables being provided with an insulator, an outer conductor, and a sheath successively disposed in a coaxial arrangement around a center conductor. At one end portion of the multi-core coaxial cable, the plurality of coaxial cables are exposed from the cable sheath and arranged in parallel rows. The connecting member is connected to one end portion of the multi-core coaxial cable, and the center conductors and the outer conductors of the plurality of coaxial cables are conductively connected to the respective terminal portions of the connecting member. The covering member covers the periphery of the plurality of coaxial cables between the cable sheath and the connecting member, and is arranged such that distance from the end portion at the connecting member side of the covering member to the edge of the connecting member is 20 mm or less.

In the connecting member-terminated multi-core coaxial cable of the present invention, optionally, the plurality of coaxial cables are divided into a plurality of coaxial cable groups and arranged in respective parallel rows in a plurality of coaxial cable groups, the coaxial cable groups being connected to the connecting member in an overlapping manner. In this case, the outer conductor is preferably exposed in the same location in each of the plurality of coaxial cable groups, and is conductively connected in an integrated fashion to a ground terminal. In preferred practice, the distance from the end portion at the connecting member side of the covering member to the edge of the connecting member is 5 mm or less. One example of the covering member is a heat shrinkable tube formed from a heat shrinkable resin.

Another aspect of the present invention provides a method for manufacturing a connecting member-terminated multi-core coaxial cable having a multi-core coaxial cable and a connecting member, the multi-core coaxial cable having a plurality of coaxial cables collectively covered by a cable sheath. Each of the cables is provided with an insulator, an outer conductor, and a sheath successively disposed in a coaxial arrangement around a center conductor. The manufacturing method includes a sheath stripping step, an alignment step, a terminal processing step, a conductor connection step, and a covering attachment step. In the sheath stripping step, the cable sheath at the end portion is stripped to expose the plurality of coaxial cables. In the alignment step, the plurality of coaxial cables which are exposed are arranged in parallel rows. In the terminal processing step, the center conductors and the outer conductors of the plurality of coaxial cables are exposed. In the conductor connection step, the center conductors and the outer conductors of the coaxial cables are respectively conductively connected to terminal portions of the connecting member. In the covering attachment step, the covering member is attached to the periphery of the plurality of coaxial cables between the cable sheath and the connecting member, so that the distance from the end portion at the connecting member side to the edge of the connecting member is 20 mm or less.

In the method for manufacturing a connecting member-terminated multi-core coaxial cable of the present invention, preferably, in the alignment step, the plurality of coaxial cables are divided into a plurality of coaxial cable groups and arranged in respective parallel rows in the plurality of coaxial cable groups; and in the conductor connection step, the coaxial cable groups are connected to the connecting member in an overlapping state. Preferably, in the terminal processing step, the outer conductor is exposed in the plurality of coaxial cable groups in the same location on the connecting member. In the conductor connection step, the outer conductors are conductively connected in an integrated fashion to a ground terminal. In preferred practice, in the covering attachment step, the covering member is attached such that the distance from the end portion at the connecting member side of the covering member to the edge of the connecting member is 5 mm or less.

Effect of the Invention

According to the connecting member-terminated multi-core coaxial cable of the present invention, coaxial cables which have been exposed from the cable sheath may be well protected by a covering member which has been disposed such that the distance from the end portion thereof to the connecting member is 20 mm or less. Also, according to the method for manufacturing a connecting member-terminated multi-core coaxial cable of the present invention, during terminal processing of the coaxial cables prior to installation of the covering member, the exposed length of the coaxial cables from the cable sheath is sufficiently great for the terminal processing procedure to take place efficiently. Therefore, operability during coaxial cable terminal processing may be significantly improved, dimensional accuracy subsequent to processing may be improved in the connecting member-terminated multi-core coaxial cable, and a negligible defect rate may be attained.

DETAILED DESCRIPTION OF THE INVENTION

Figure 1:
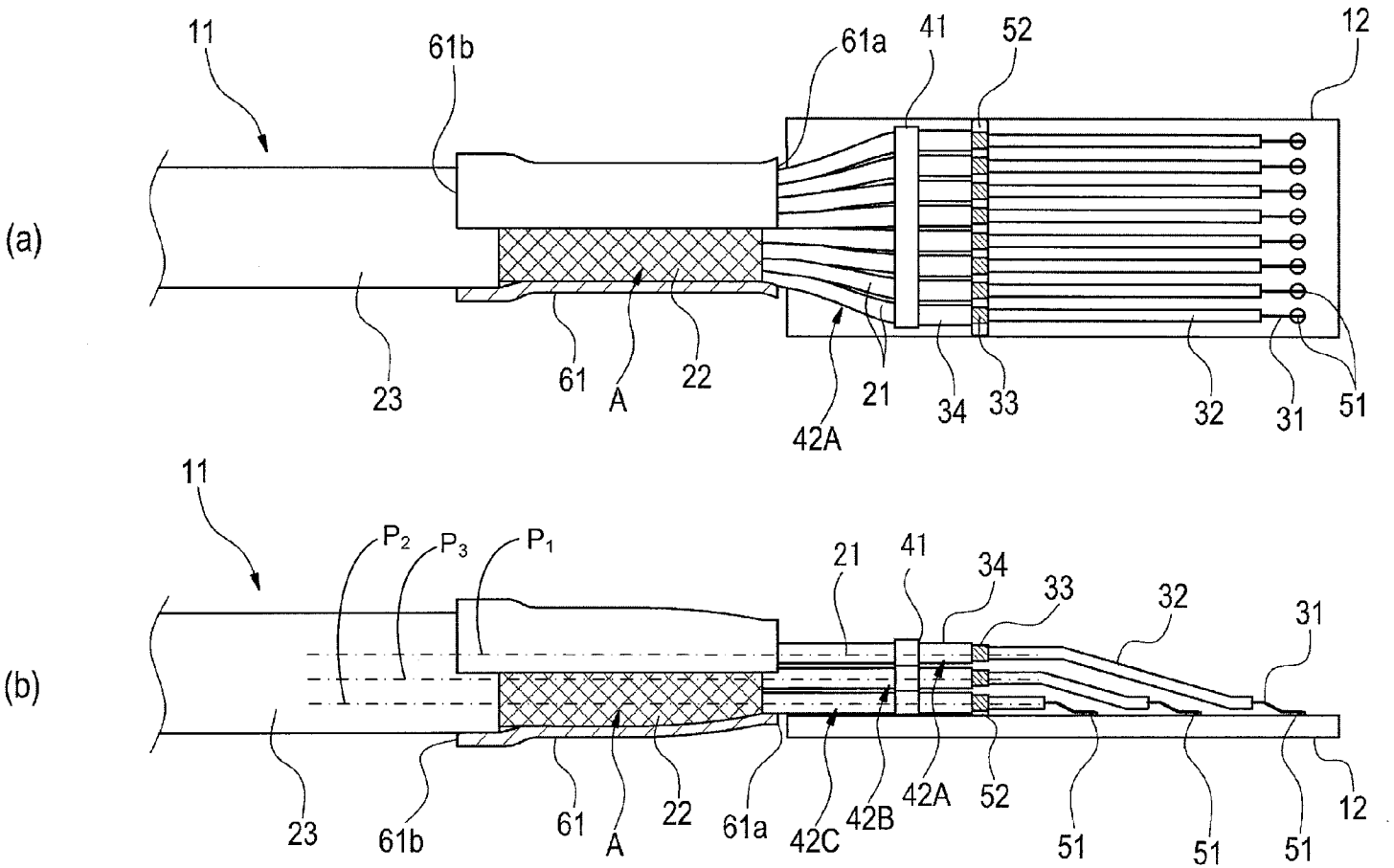
FIG. 1 is a fragmentary development view showing an end portion of an embodiment of a connecting member-terminated multi-core coaxial cable according to the present invention, wherein area (a) is a view taken in a direction orthogonal to a circuit board, and area (b) is a view taken in a direction parallel to the circuit board.

The embodiments of the present invention are described below with reference to the drawings. The drawings are intended for illustrative purposes, and are not limiting of the invention. In the drawings, in order to avoid redundant description, like symbols indicate like components. Dimensional proportions in the drawings are not necessarily accurate.

FIG. 1 is a fragmentary development view showing an end portion of a connecting member-terminated multi-core coaxial cable according to an embodiment of the present invention, wherein area (a) is a view taken in a direction orthogonal to a circuit board 12, and area (b) is a view taken in a direction parallel to the circuit board 12. The connecting member-terminated multi-core coaxial cable is provided with a multi-core coaxial cable 11 and a circuit board (connecting member) 12 which is connected to the multi-core coaxial cable 11. The circuit board 12 is disposed, for example, at the tip of an endoscope.

Figure 2:
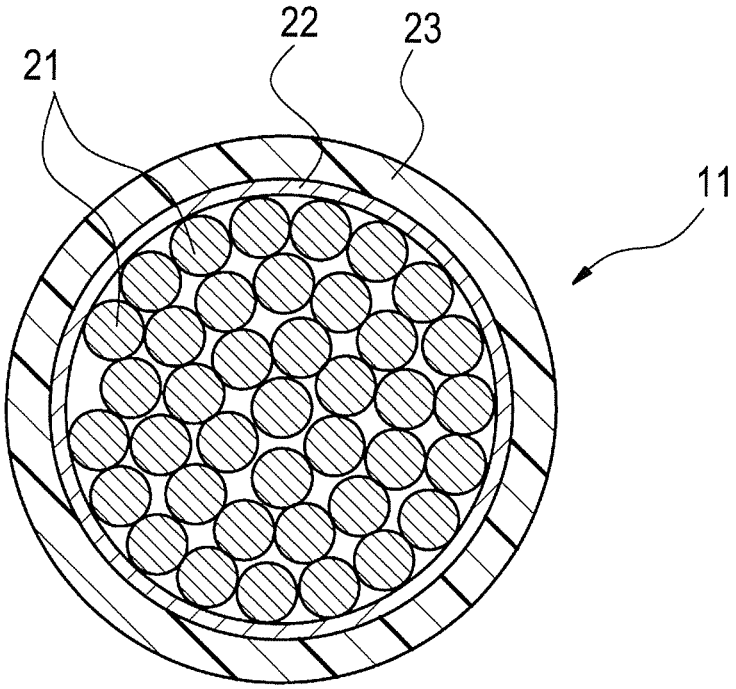
FIG. 2 is a transverse sectional view of a multi-core coaxial cable making up an embodiment of a connecting member-terminated multi-core coaxial cable according to the present invention.

FIG. 2 is a transverse sectional view of the multi-core coaxial cable 11. The multi-core coaxial cable 11 includes a plurality (e.g., 24) of bundled coaxial cables 21. A shield layer 22 made of braided copper alloy wire covers around the outside of the plurality of coaxial cables 21 for the purpose of ensuring shielding and mechanical reinforcement, and this assembly is further covered by a cable sheath 23. For the cable sheath 23, there is used a resin having the characteristics required of the moving part of an endoscope, specifically, excellent flexibility, wear resistance, and mechanical characteristics; fluororesins, polyvinyl chloride (PVC), urethane, polyolefins, silicone, polyvinylidene chloride, or the like may be used, for example.

Figure 3:
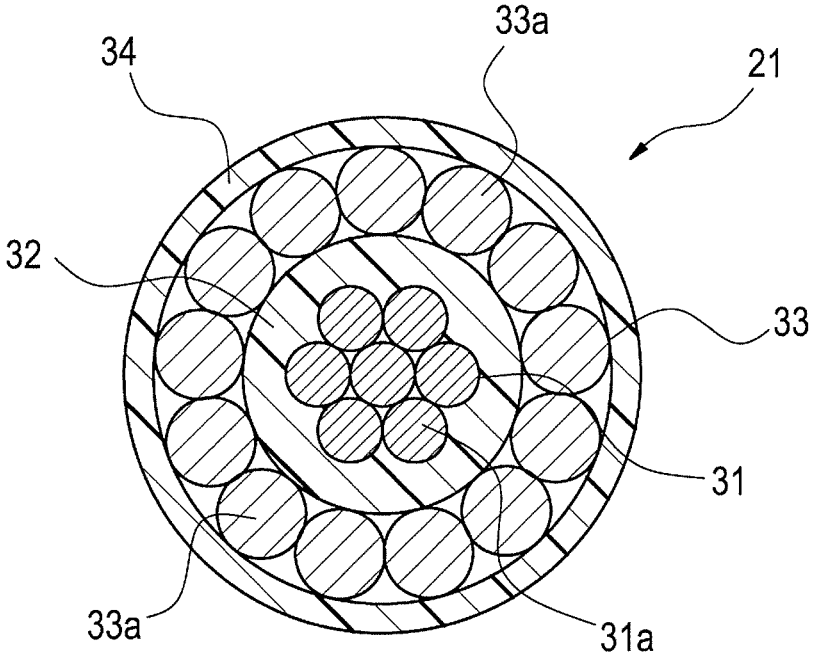
FIG. 3 is a transverse sectional view of a coaxial cable included in an embodiment of a connecting member-terminated multi-core coaxial cable according to the present invention.

FIG. 3 is a transverse sectional view of a coaxial cable 21. The coaxial cable 21 has at its center a center conductor 31, and to the outside of the center conductor 31 an insulator 32, an outer conductor 33, and a sheath 34 successively disposed in a coaxial arrangement. The center conductor 31 is formed by twisting a plurality of tin-plated copper alloy wires 31*a*, for example. The material of the insulator 32 is an insulating material made of a polyolefin (polyethylene, expanded polyethylene, etc.), an ethylene-vinyl acetate copolymer (EVA), an ethylene-ethyl acrylate copolymer (EEA), polyvinyl chloride (PVC), a fluororesin, or the like. The outer conductor 33 is composed, for example, of a plurality of copper alloy wires 33*a* wrapped in a served pattern, and the outside of the outer conductor 33 is covered by the sheath 34 which is made of a resin such as polyester.

The end portion of the multi-core coaxial cable 11 is subjected to terminal treatment carried out as follows (see FIG. 1 (*b*)). In the multi-core coaxial cable 11, the plurality of coaxial cables 21 and the shield layer 22 are exposed in stepwise fashion in order from the distal end side. The exposed plurality of coaxial cables 21 are bundled together in sets of a prescribed number of strands (e.g., 8 strands) with tape 41 to make up coaxial cable groups 42A, 42B, 42C. The coaxial cable groups 42A, 42B, 42C overlap one another, and within each respective group, the coaxial cables 21 are arranged in a parallel row.

The coaxial cables 21 are also subjected to terminal treatment carried out as follows. In each coaxial cable 21, the center conductor 31, the insulator 32, and the outer conductor 33 are exposed in a stepwise fashion in order from the distal end side. The exposed length of the coaxial cables 21 which make up the coaxial cable groups 42A, 42B, 42C differ by group, with the coaxial cable group 42A, the coaxial cable group 42B, and the coaxial cable group 42C having progressively shorter exposed length, in that order. More specifically as shown in FIG. 1(*b*), the coaxial cables 42A form a first row of coaxial cables that define a first plane $P_1$, the coaxial cables 42B form a second row of coaxial cables that define a second plane $P_2$, and the coaxial cables 42C form a third row of coaxial cables that define a third plane $P_3$. The first, second and third planes $P_1$, $P_2$ and $P_3$ are parallel to one another, as shown in FIG. 1(*b*), and are spaced apart from one another. The coaxial cables 21 of the coaxial cable groups 42A, 42B, 42C are conductively connected by soldering the center conductors 31 thereof to signal terminal portions (terminal portions) 51 composed of a wiring pattern disposed on the circuit board 12. More specifically, once connected to the terminal portions 51, the coaxial cables 42B (the second row) are disposed between the circuit board 12 (the connecting member) and the coaxial cables 42A (the first row) with the coaxial cables 42A overlapping the coaxial cables 42B. Further, the coaxial cables 42C (the third row) are disposed between the circuit board 12 (the connecting member) and the coaxial cables 42B (the second row).

The circuit board may be reduced in width by dividing the plurality of coaxial cables 21 into a plurality of coaxial cable groups and overlapping the coaxial cable groups. During this process, the surface area of the circuit board may also be reduced by staggering in small increments the connection locations of the center conductors. Through such an arrangement, the dimensions of the circuit board may be reduced to a size that fits inside a narrow enclosure such as that used in an endoscope.

Meanwhile, in all of the coaxial cables 21, the outer conductors 33 are exposed at the same location in the length direction (the same location on the connecting member), and are conductively connected in an integrated fashion through soldering to a ground terminal portion (terminal portion) 52 formed by a wiring pattern disposed across the width direction of the circuit board 12. By so doing, the space required to solder the outer conductors to the ground terminal portion can be smaller. Optionally, the outer conductors 33 may be collectively urged into continuity with the ground terminal portion 52 of the circuit board 12 by a ground bar.

A covering tube (covering member) 61 is installed on an exposed portion A where the cable sheath 23 has been stripped from the multi-core coaxial cable 11 connected to the circuit board 12, in such a way as to cover the shield layer 22. The covering tube 61 is disposed in intimate contact around the exposed portion A. As shown in FIGS. 1(*a*) and 1(*b*), the covering tube 61 is positioned such that a distance $L_1$ from the end portion 61*a* on the circuit board 12 side thereof to the edge of the circuit board 12 is 20 mm or less. The end portion 61*b* of the covering tube 61 on the opposite side thereof from the circuit board 12 overlaps the cable sheath 23 so as to cover the outside at the end portion of the cable sheath 23. The multi-core coaxial cable 11 has a diameter D, as indicated in FIG. 1(*b*).

In the multi-core coaxial cable 11, it is necessary for the coaxial cables to have prescribed length from the locations where they are disassembled to the locations where they are arrayed in parallel rows. During terminal processing of the coaxial cables 21 prior to installing the covering tube 61, the exposed length of the coaxial cables 21 from the cable sheath 23 may be made large enough that the terminal processing operation can take place efficiently. The coaxial cables 21 may be arrayed in parallel rows thereby. Additionally, operability in terminal processing of the coaxial cables 21 prior to installing the covering tube 61 can be significantly improved, dimensional accuracy subsequent to processing may be enhanced, and a negligible defect rate may be attained.

By positioning the covering tube 61 such that the distance from the end portion 61*a* thereof to the edge of the circuit board 12 is 20 mm or less, the coaxial cables 21 which have been exposed from the cable sheath 23 may be well protected. Moreover, movement in the lengthwise direction of the cable sheath 23 can be restricted by the covering tube 61, and the cable sheath 23 may be prevented from shifting out of place. By using the covering tube to cover the shield layer or coaxial cables again which were previously exposed by stripping the sheath, the distance from the edge of the circuit board to the cable sheath (covering tube) can be kept to 20 mm or less. By using this method, there may be produced multi-core coaxial cables in which the dimension from the stripped portion to the circuit board is 5 mm or less, such as about 2 to 3 mm, for example.

Figure 4:
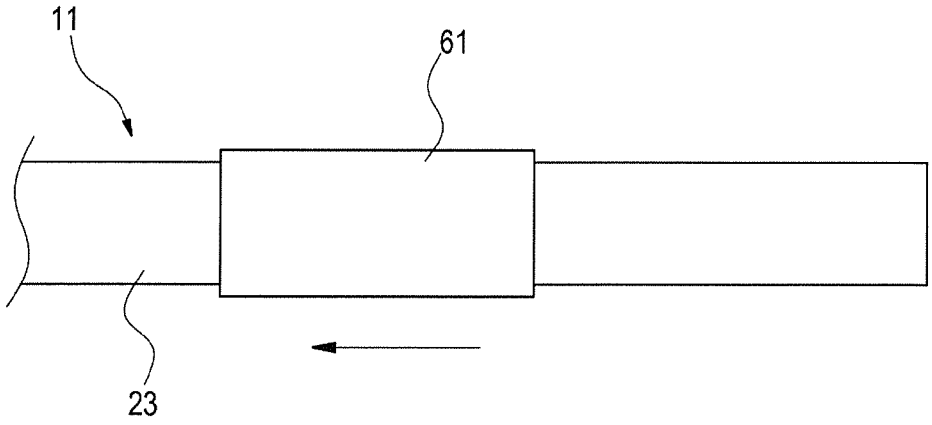
FIG. 4 is an illustration of an embodiment of a method for manufacturing a connecting-member-terminated multi-core coaxial cable according to the present invention, and depicts in side view an end portion of a multi-core coaxial cable prior to performing terminal processing.
Figure 5:
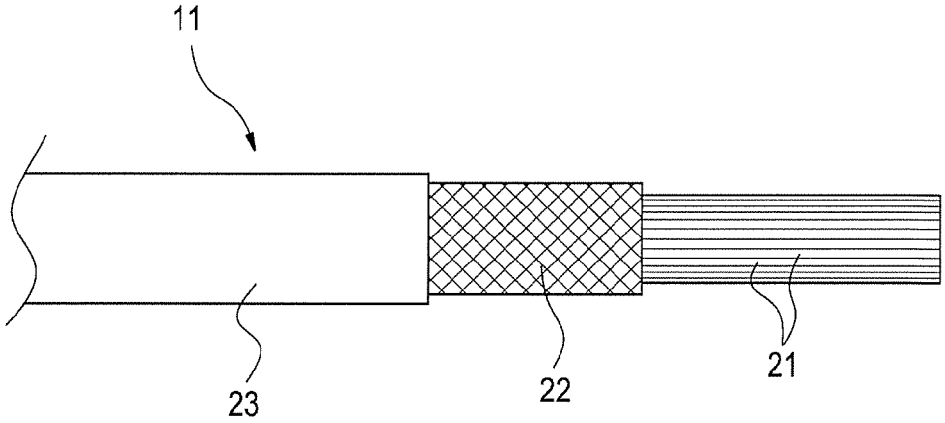
FIG. 5 is an illustration of an embodiment of a method for manufacturing a connecting member-terminated multi-core coaxial cable according to the present invention, and depicts in side view an end portion of a multi-core coaxial cable subsequent to stripping of a prescribed cable sheath and shield layer.
Figure 6:
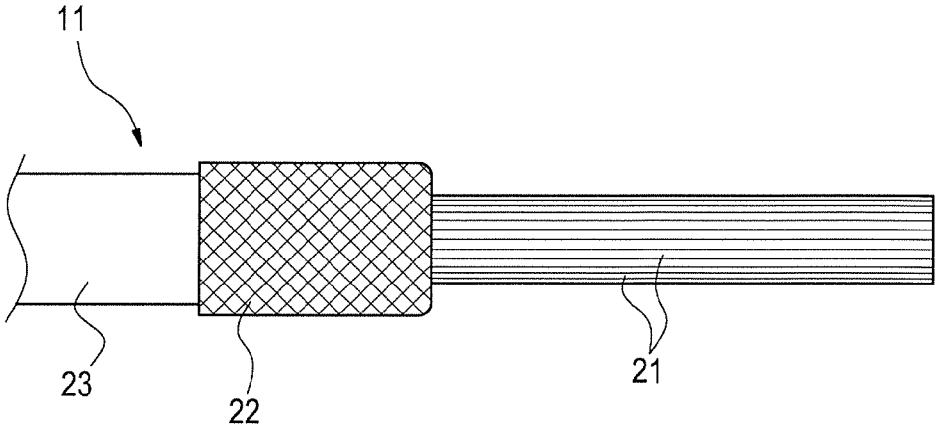
FIG. 6 is an illustration of an embodiment of a method for manufacturing a connecting member-terminated multi-core coaxial cable according to the present invention, and depicts in side view an end portion of a multi-core coaxial cable subsequent to folding back of the shield layer.

Next, the method for manufacturing the connecting member-terminated multi-core coaxial cable which includes the multi-core coaxial cable 11 connected to the circuit board 12 will be described. First, the as yet unshrunken covering tube 61 is slipped around the multi-core coaxial cable 11 from the end portion thereof through (FIG. 4). Next, at the end portion of the multi-core coaxial cable 11, in order to expose the coaxial cables 21 to the required length for terminal processing and alignment (e.g., about 40 mm or 50 mm), the cable sheath 23 is cut with a $CO_2$ laser and pulled toward the end portion side to strip the cable sheath (sheath stripping step). Also, the shield layer 22 is cut at a prescribed location by a YAG laser and pulled toward the end portion side to strip the portion which is not needed for terminal processing (FIG. 5). The shield layer 22 is then folded back towards the opposite side from the end portion, and is secured to the outside of the cable sheath 23 with tape or the like (FIG. 6).

Figure 7:
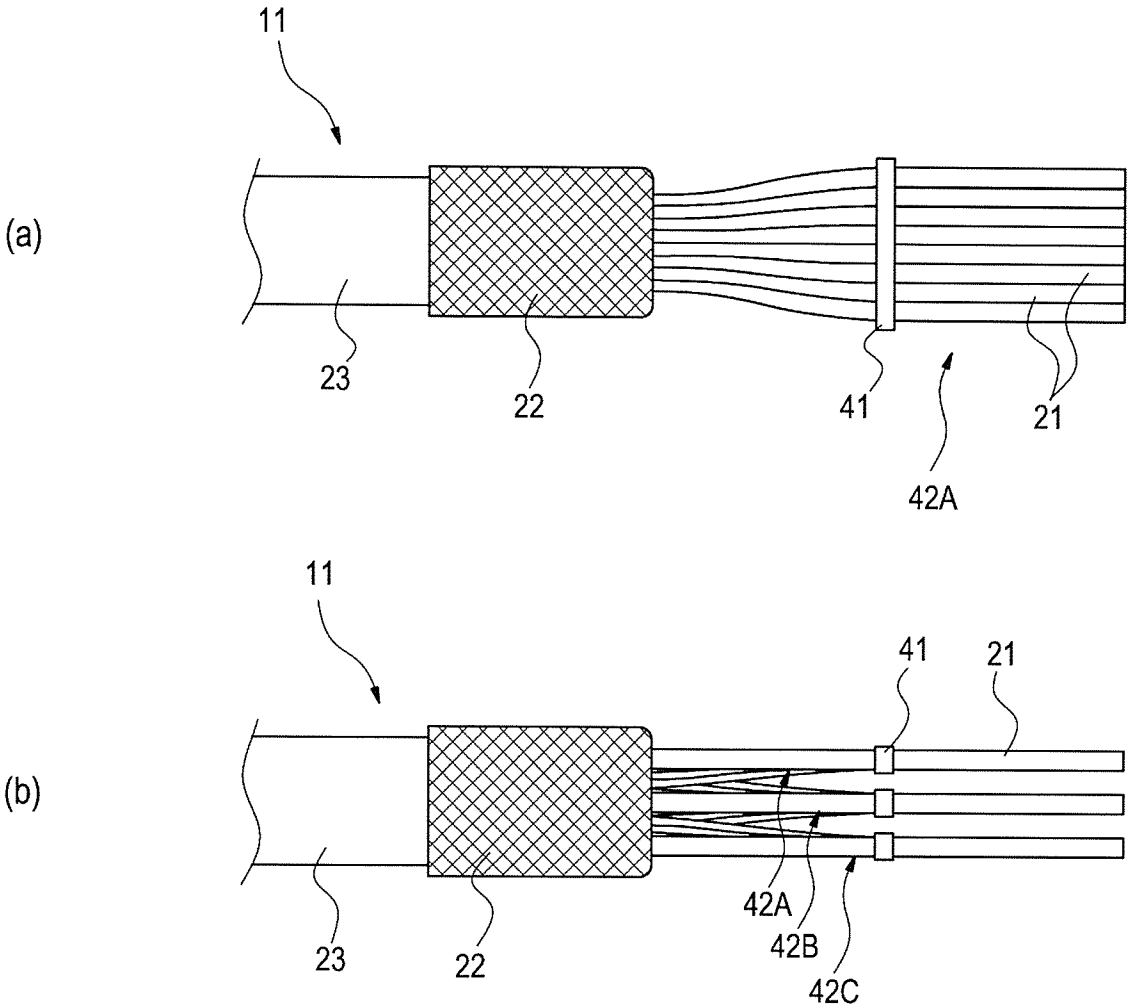
FIG. 7 is an illustration of an alignment step in an embodiment of a method for manufacturing a connecting member-terminated multi-core coaxial cable according to the present invention, wherein area (a) is a plan view of an end portion of a multi-core coaxial cable, and area (b) is a side view thereof.

FIG. 7 is an illustration of an alignment step in an embodiment of a method for manufacturing a connecting member-terminated multi-core coaxial cable according to the present invention, wherein area (a) is a plan view of the end portion of the multi-core coaxial cable 11, and area (b) is a side view thereof. In the alignment step, the plurality of coaxial cables 21 are divided into groups containing a prescribed number of strands (e.g., 8 strands), creating flat coaxial cable groups 42A, 42B, 42C with tape 41. Within each of the respective coaxial cable groups 42A, 42B, 42C, the coaxial cables 21 are arranged in parallel rows disposed in a plane.

Figure 8:
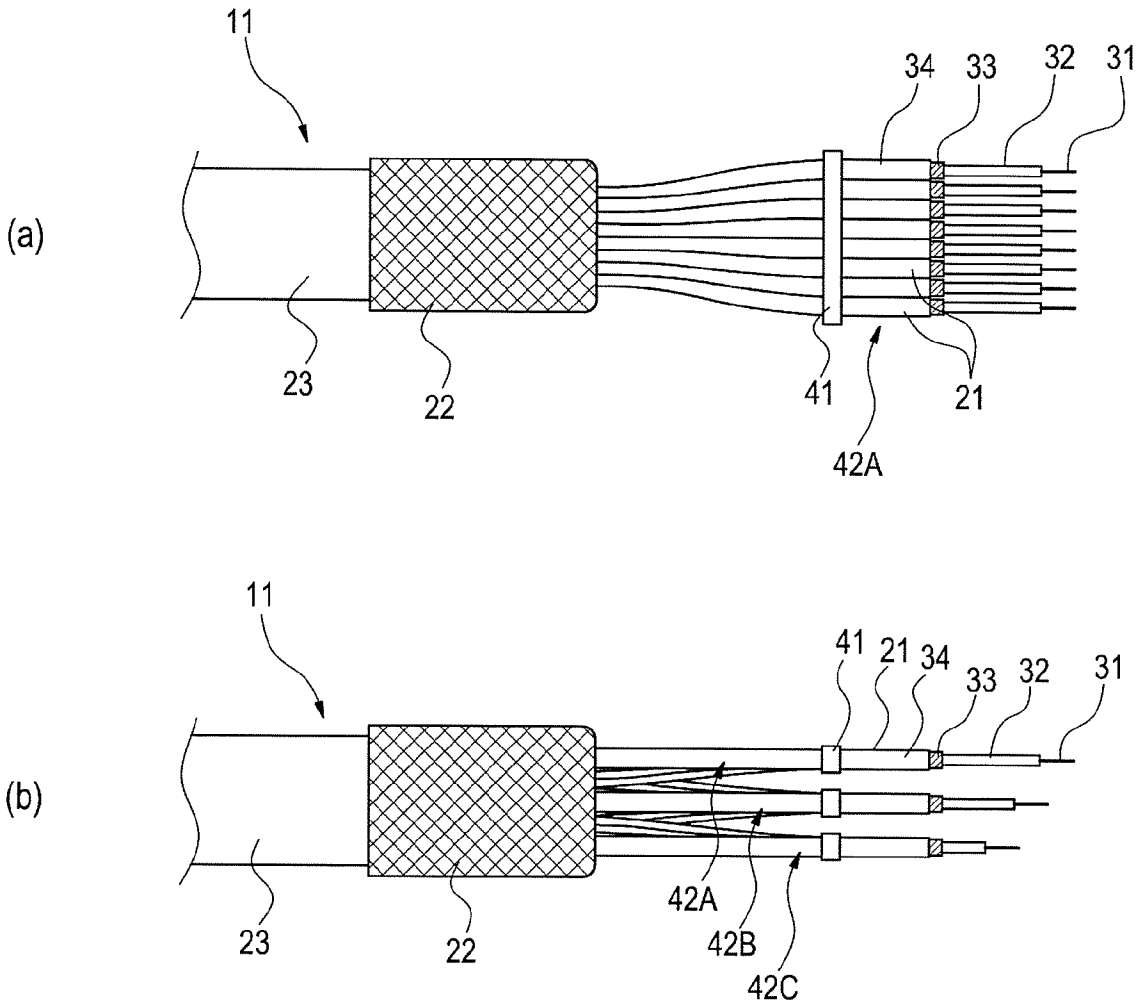
FIG. 8 is an illustration of a terminal processing step in an embodiment of a method for manufacturing a connecting member-terminated multi-core coaxial cable according to the present invention, wherein area (a) is a plan view of an end portion of a multi-core coaxial cable, and area (b) is a side view thereof.

FIG. 8 is an illustration of a terminal processing step in an embodiment of a method for manufacturing a connecting member-terminated multi-core coaxial cable according to the present invention, wherein area (a) is a plan view of the end portion of the multi-core coaxial cable 11, and area (b) is a side view thereof. In the terminal processing step, first, the lengths of the coaxial cables 21 of the groups are adjusted such that the lengths of the exposed portions of the coaxial cables 21 increases in the coaxial cable group 42A, the coaxial cable group 42B, and the coaxial cable group 42C in that order. Subsequently, the sheaths 34 of the coaxial cables are cut at the same location in the lengthwise direction with a $CO_2$ laser and stripped. The outer conductors 33 are cut at the same location in the lengthwise direction with a YAG laser and stripped. Further, the insulators 32 are cut in proximity to the end portion with a $CO_2$ laser and stripped. The center conductor 31, the insulator 32, and the outer conductor 33 of each of the coaxial cables 21 are thereby respectively exposed in stepwise fashion in order from the distal end side.

Figure 9:
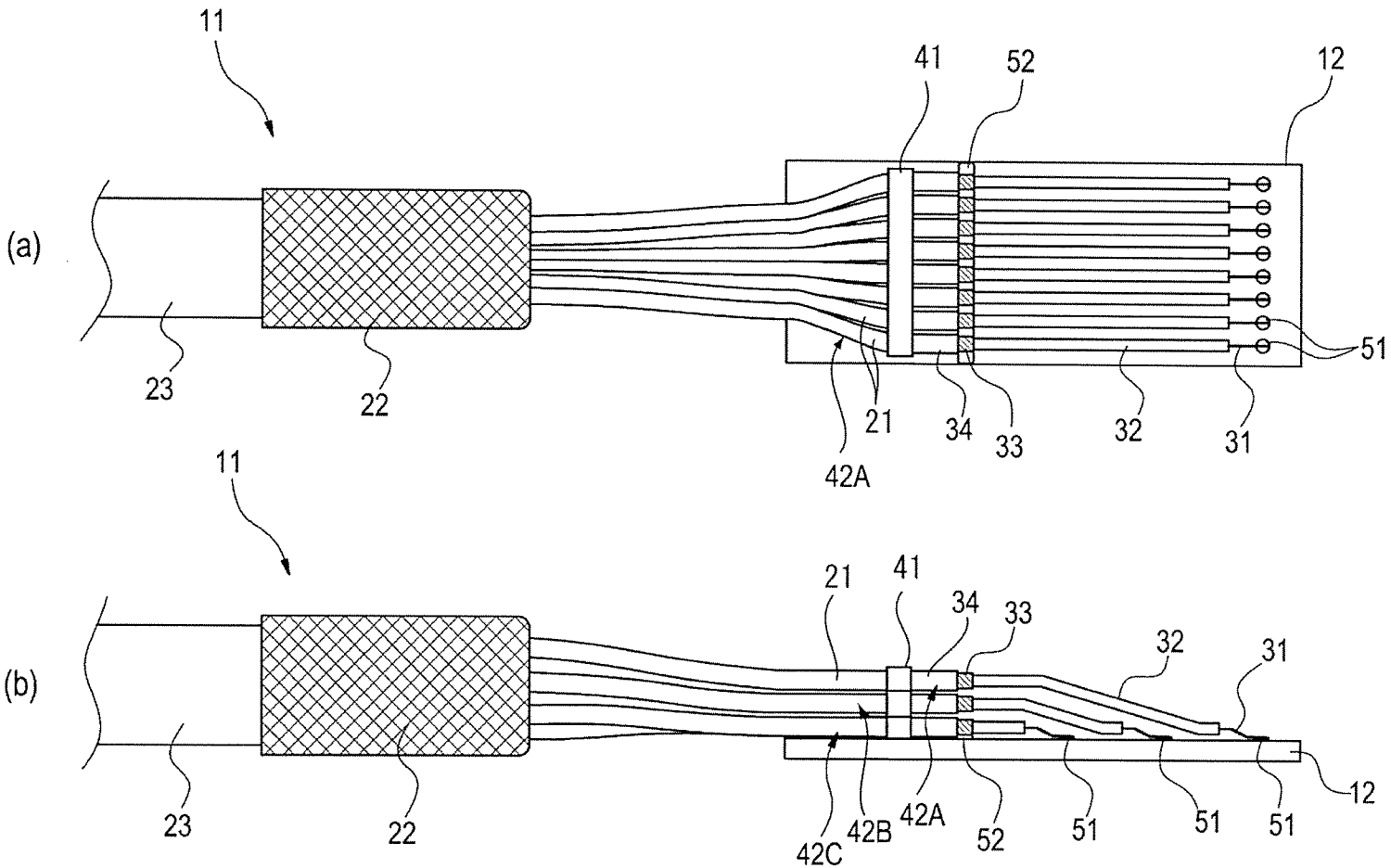
FIG. 9 is an illustration of a conductor connection step in an embodiment of a method for manufacturing a connecting member-terminated multi-core coaxial cable according to the present invention, wherein area (a) is a plan view of an end portion of a multi-core coaxial cable, and area (b) is a side view thereof.

FIG. 9 is an illustration of a conductor connection step in an embodiment of a method for manufacturing a connecting member-terminated multi-core coaxial cable according to the present invention, wherein area (a) is a plan view of the end portion of the multi-core coaxial cable 11, and area (b) is a side view thereof. In the conductor connection step, the center conductors 31 of the coaxial cable groups 42A, 42B, 42C are conductively connected through soldering to the signal terminal portions 51 of the circuit board 12. The outside conductors 33 are conductively connected in an integrated fashion by soldering to the ground terminal portion 52 of the circuit board 12. As shown in FIG. 1(*b*), a distance $L_2$ is defined between the end portion at the connecting member side of the cable sheath and the tip portion of the exposed coaxial cable. As is clearly shown in FIGS. 1(*a*) and 1(*b*), the distance $L_1$ is less than 50% of the distance $L_2$. Preferably, the distance $L_1$ is less than 5 times of the diameter D of the multi-core coaxial cable 11.

Figure 10:
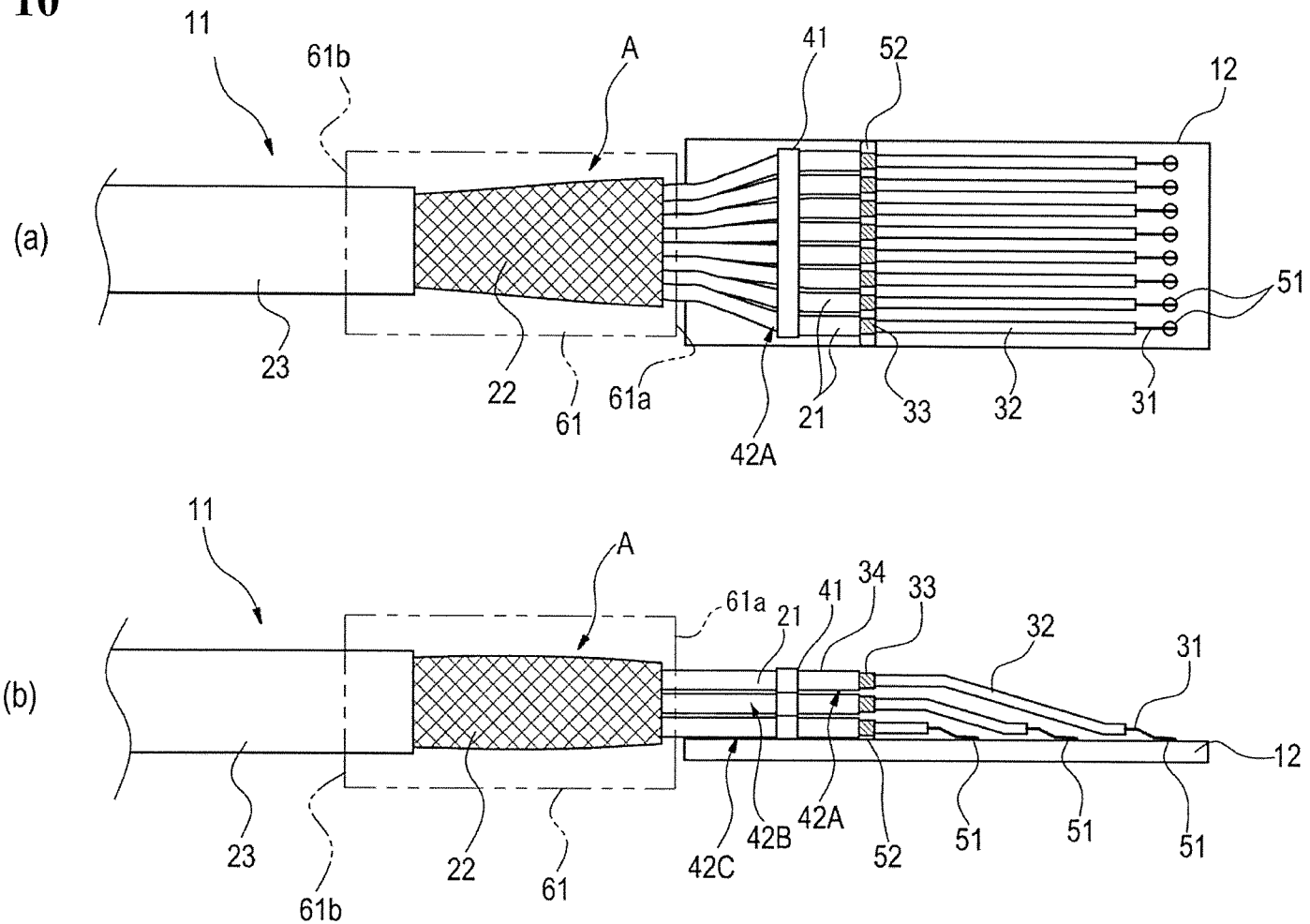
FIG. 10 is an illustration of a covering attachment step in an embodiment of a method for manufacturing a connecting member-terminated multi-core coaxial cable according to the present invention, wherein area (a) is a plan view of an end portion of a multi-core coaxial cable, and area (b) is a side view thereof.

FIG. 10 is an illustration of a covering attachment step in an embodiment of a method for manufacturing a connecting member-terminated multi-core coaxial cable according to the present invention, wherein area (a) is a plan view of the end portion of the multi-core coaxial cable 11, and area (b) is a side view thereof. In the covering attachment step, the folded back shield layer 22 is returned to its original condition. Then, the covering tube 61 which was previously slipped onto the multi-core coaxial cable 11 is positioned between the cable sheath 23 and the circuit board 12, and the covering tube 61 is heated and heat shrunk to bring the covering tube 61 into intimate contact between the cable sheath 23 and the circuit board 12.

According to the embodiment of the manufacturing method described above, terminal processing of the coaxial cables 21 is carried out with the coaxial cables 21 sufficiently exposed from the cable sheath 23, whereby terminal processing of the coaxial cables 21 may be carried out easily, and multi-core coaxial cables 11 having excellent dimensional accuracy can be manufactured smoothly with a negligible defect rate.

Where the plurality of coaxial cables 21 are divided into a plurality of coaxial cable groups, the number of groups is not limited to that taught in the preceding embodiment. Optionally, the plurality of coaxial cables 21 may be positioned in a single row and connected to the circuit board 12 without being divided into a plurality of coaxial cable groups. Additionally, it is not essential to provide the shield layer 22. In this case, the covering tube 61 would directly cover the outside of the coaxial cables 21. Optionally, wrapping tape may be disposed around the plurality of coaxial cables 21, in which case the covering tube 61 would cover the outside of the coaxial cables 21 via the wrapping tape.

In the preceding embodiment, the present invention was described in terms of a multi-core coaxial cable connected at one end to a connecting member and a method for the manufacture thereof; however, the connecting member-terminated multi-core coaxial cable of the present invention may be connected at both ends to connecting members. While the connecting member was described as a circuit board 12 by way of example, the invention is applicable in instances where the connecting member is a connector, and the coaxial cables are connected to the connector.

INDUSTRIAL APPLICABILITY

The invention is useful as a connecting member-terminated multi-core coaxial cable in medical devices and the like.

PRIOR ART CITATION

Patent Citation

[Patent Citation 1] Japanese Unexamined Patent Application 2003-123552

What is claimed is:

1. A connecting member-terminated multi-core coaxial cable, comprising:

a multi-core coaxial cable having a plurality of coaxial cables collectively covered by a cable sheath, each of which cables being provided with an insulator, an outer conductor, and a sheath successively disposed in a coaxial arrangement around a center conductor, and the cables being exposed from the cable sheath and arranged in parallel rows at one end portion of said multi-core coaxial cable, such that at the end portion the plurality of coaxial cables are divided into at least a first row of coaxial cables that define a first plane and a second row of coaxial cables that define a second plane that is parallel to the first plane and spaced apart from the first plane;

a connecting member connected to one end portion of the multi-core coaxial cable, the center conductors and the outer conductors of the plurality of coaxial cables being conductively connected to respective terminal portions of the connecting member such that the second row of coaxial cables are disposed between the connecting member and the first row of coaxial cables with the first row of coaxial cables overlapping the second row of coaxial cables; and a covering member covering a periphery of the plurality of coaxial cables between the cable sheath and the connecting member, the covering member being arranged such that the distance from the end portion at the connecting member side of the covering member to the edge of the connecting member is less than 5% of the length of the connecting member.

2. The connecting member-terminated multi-core coaxial cable according to claim 1, wherein the outer conductor is exposed in the same location in each of the plurality of coaxial cable groups, and is conductively connected in an integrated fashion to a ground terminal.

3. The connecting member-terminated multi-core coaxial cable according to claim 1, wherein the distance from the end portion at the connecting member side of the covering member to the edge of the connecting member is 5 mm or less.

4. The connecting member-terminated multi-core coaxial cable according to claim 1, wherein the covering member is a heat shrinkable tube formed from a heat shrinkable resin.

5. A method for manufacturing a connecting member-terminated multi-core coaxial cable having a multi-core coaxial cable and a connecting member, the multi-core coaxial cable having a plurality of coaxial cables collectively covered by a cable sheath, and each of the cables being provided with an insulator, an outer conductor, and a sheath successively disposed in a coaxial arrangement around a center conductor; wherein the method for manufacturing a connecting member-terminated multi-core coaxial cable comprises:

a sheath stripping step for stripping the cable sheath at the end portion to expose the plurality of coaxial cables;

an alignment step for arranging the exposed plurality of coaxial cables in parallel rows such that at the end portion the exposed plurality of coaxial cables are divided into at least a first row of coaxial cables that define a first plane and a second row of coaxial cables that define a second plane that is parallel to the first plane and spaced apart from the first plane;

a terminal processing step for exposing the center conductors and the outside conductors of each of the plurality of coaxial cables;

a conductor connection step for conductively connecting the center conductors and the outside conductors of the coaxial cables respectively to terminal portions of the connecting member such that the second row of coaxial cables extend between the connecting member and the first row of coaxial cables with the first row of coaxial cables overlapping the second row of coaxial cables; and a covering attachment step for attaching the covering member to the periphery of the plurality of coaxial cables between the cable sheath and the connecting member, so that the distance from the end portion at the connecting member side to the edge of the connecting member is less than 5% of the length of the connecting member.

6. The method for manufacturing a connecting member-terminated multi-core coaxial cable according to claim 5, wherein in the terminal processing step, the outer conductor in the plurality of coaxial cable groups is exposed in the same location on the connecting member; and in the conductor connection step, the outer conductors are conductively connected in an integrated fashion to a ground terminal.

7. The method for manufacturing a connecting member-terminated multi-core coaxial cable according to claim 5, wherein in the covering attachment step, the covering member is attached so that the distance from the end portion at the connecting member side of the covering member to the edge of the connecting member is 5 mm or less.

8. The connecting member-terminated multi-core coaxial cable according to claim 1, wherein the distance from the end portion at the connecting member side of the covering member to the edge of the connecting member is 20 mm or less.

9. The connecting member-terminated multi-core coaxial cable according to claim 1, wherein the distance from the end portion at the connecting member side of the covering member to the edge of the connecting member is approximately half a distance between the end portion at the connecting member side of the cable sheath and the tip portion of the exposed coaxial cable.

10. The method for manufacturing a connecting member-terminated multi-core coaxial cable according to claim 5, wherein the distance from the end portion at the connecting member side of the covering member to the edge of the connecting member is 20 mm or less.

11. The method for manufacturing a connecting member-terminated multi-core coaxial cable according to claim 5, wherein the distance from the end portion at the connecting member side of the covering member to the edge of the connecting member is approximately half a distance between the end portion at the connecting member side of the cable sheath and the tip portion of the exposed coaxial cable.

12. The connecting member-terminated multi-core coaxial cable according to claim 1, wherein the plurality of coaxial cables at the end portion are further divided into a third row of coaxial cables that define a third plane that is parallel to the first plane and the second plane, and the third row of coaxial cables are disposed between the connecting member and the second row of coaxial cables.

13. The method for manufacturing a connecting member-terminated multi-core coaxial cable according to claim 5, wherein in the alignment step the exposed plurality of coaxial cables are further divided into a third row of coaxial cables that define a third plane that is parallel to the first plane and the second plane; and in the conductor connection step, the third row of coaxial cables extend between the connecting member and the second row of coaxial cables with the second row of coaxial cables overlapping the third row of coaxial cables.

* * * * *